United States Patent [19]

Rennebaum et al.

[11] 4,244,534

[45] Jan. 13, 1981

[54] STRIP COILER

[75] Inventors: Heinrich Rennebaum, Menden; Benito Kakoschke, Hemer, both of Fed. Rep. of Germany

[73] Assignee: Sundwiger Eisenhütte Maschinenfabrik Grah & Co., Hemer-Sundwig, Fed. Rep. of Germany

[21] Appl. No.: 95,334

[22] Filed: Nov. 19, 1979

[30] Foreign Application Priority Data

Nov. 22, 1978 [DE] Fed. Rep. of Germany ..... 2850560

[51] Int. Cl.[3] ..... B65H 75/28

[52] U.S. Cl. ..... 242/72.1; 242/78.1

[58] Field of Search ..... 242/72, 72.1, 78.1, 242/78.6, 82

[56] References Cited

U.S. PATENT DOCUMENTS

| | | | |
|---|---|---|---|
| 2,755,031 | 7/1956 | Russell | 242/72.1 |
| 3,116,891 | 1/1964 | Anderson | 242/72.1 |
| 3,300,157 | 1/1967 | Koreishi | 242/78.1 |
| 3,870,243 | 3/1975 | Briggs | 242/72.1 |

*Primary Examiner*—Edward J. McCarthy
*Attorney, Agent, or Firm*—Kenyon & Kenyon

[57] ABSTRACT

A strip coiler has an expandable coiling drum having on one end an outward flange which fits against an outward end flange on the end of a rotative drive shaft. The interfaces of the flanges have radial interlocking grooves and ridges. To hold the flanges tightly together, a collar encircles the flanges and has inward flanges embracing the outward flanges of the drum and shaft. The drum's flange and the corresponding inward flange of the ring form a bayonet joint so that by partial relative rotation of the ring and drum the drum can be removed and replaced. The flange of the collar which engages the shaft's flange is provided with a fluid pressure means so that when the bayonet joint is in its locked condition, the drum and shaft flanges are forced tightly together when this means is provided with fluid pressure. Release of the fluid pressure permits relatively easy partial rotation to unlock the bayonet joint for removal or replacement of the drum and its flange with respect to the flange of the drive shaft. The expandable drum is actuated by fluid pressure means interconnected with the fluid pressure means of the collar's flange so that the two are simultaneously activated, valve means maintaining the fluid pressure means of the ring's flange continuously under pressure until such pressure is released by a separate pressure release valve.

7 Claims, 3 Drawing Figures

27
42
26
28
25
24
45
4
2
40
5a
41
21
3
5
1
33
6
7
I
44
23
9
I
14
13
12
22
19
11
10
8
20
17
18
15
16

38
43
29
33
37
38a
39
6
34
35
7
9
30

9
32
31

STRIP COILER

BACKGROUND OF THE INVENTION

Strip coilers have been made with a coiling and uncoiling expandable drum having an outward flange on one end releasably connected to a mating outward flange on the end of a rotative drive shaft, by a collar or clamping ring having inward flanges embracing the outward flanges of the drum and shaft. The drum flange and the corresponding flange of the collar form a bayonet joint so that by relative rotation of the collar and drum, the drum and its flange can be released. To force the drum and shaft flanges together to provide a firm connection, one of the collar's inward flanges and one of the outward flanges of the shaft or drum have been provided with rotatively actuated cam surfaces so that by forcible rotation, the two outward flanges are mechanically forced together.

A strip coiler operates under conditions of high stress. Therefore, for the partial rotation required to release the drum, an undesirable torque force is required, customarily obtained by the use of a spanner wrench having a very long handle, the use of a heavy hammer often being required as an assisting force. For reinstallation of the drum and its flange, the same kind of expedients are required.

Plainly, an undesirable amount of trouble is involved in releasing and reinstalling the drum of such a coiler. In addition, the cam surfaces required involve relatively precision machining operations to ensure a proper cam action, this representing an undesirable coiler manufacturing expense.

The object of the present invention is to provide a coiler permitting relatively easy release of the coiler and drive shaft flanges and which eliminates the cam surfaces and their attendant manufacturing expense.

SUMMARY OF THE INVENTION

Briefly stated, to achieve the above object, the outward flange of the drive shaft and its intercontacting inward flange of the collar are provided with cooperative fluid pressure means which when activated by fluid pressure, presses together the drum and shaft flanges as firmly as is effected by the mechanical cam arrangement. The drum and shaft flanges are thus clamped firmly together but by release of the pressure of the fluid pressure means the drum and collar can be easily relatively partially rotated for release of the bayonet joint while the precision manufacturing technique required by the cam arrangement is eliminated.

Actuation of the expandable drum is effected by a push rod extending through an axial passage in the drive shaft to the end of the drive shaft opposite the drum. At this location a fluid pressure operated device applies drum expanding movement to the push rod, while the fluid pressure required for its actuation is simultaneously transmitted to the fluid pressure means of the collar's flange, a check valve holding the pressure on the latter means when once applied. A separate pressure relief valve is provided to release the pressure on the collar flange's pressure release means when it is desired to release the drum. Drum expanding and contraction is effected as required without release of the pressure on the pressure means of the collar's flange.

DESCRIPTION OF THE DRAWINGS

The drawings illustrate a specific example of the present invention, the various figures being as follows.

DETAILED DESCRIPTION OF THE INVENTION

Figure 1:
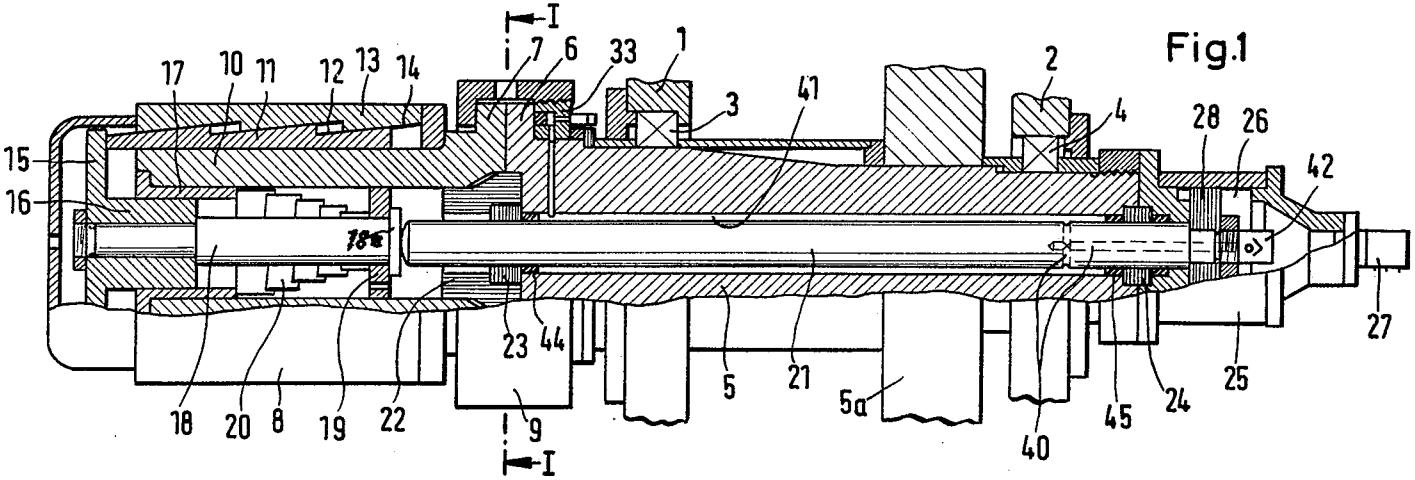
FIG. 1 is a longitudinal section of a coiler embodying the present invention.
Figure 3:
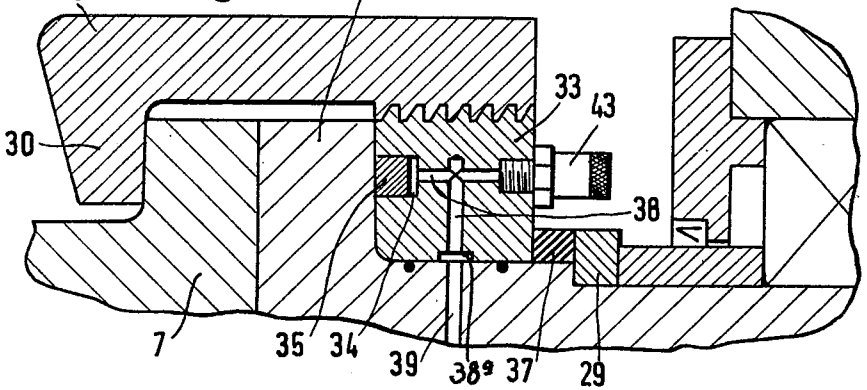
FIG. 3 on an enlarged scale, in longitudinal section, shows the details of the drum and shaft flanges and the collar and its flanges including the fluid pressure means providing the clamping pressure.

Having reference to the above drawings, the framework of the coiler is shown at 1 and 2 as journaling via bearings 3 and 4 the rotative drive shaft 5 which is of tubular construction. A rotative power input gear, partially shown at 5*a*, serves to apply the rotative drive to the shaft 5, the shaft and gear being keyed together. The drive shaft's outward flange is shown at 6 as mating with the outward flange 7 of the expandable and contractable coiling drum 8. Although not shown, the interfaces of the flanges 6 and 7 are respectively provided with interfitting radial tongues and grooves forming a releasable spline connection between the flanges. The collar which clamps the flanges 6 and 7 together is shown at 9.

The coiling drum 8 comprises a tubular shaft 10 extending integrally from the flange 7, the shaft 10 externally mounting axially sliding wedges 11 having outward wedge surfaces 12 which expand and contract a cylindrical array of segments 13 which are cylindrical segments forming the strip coiling surface, the segments having inward wedge surfaces 14 cooperating with the surfaces 12. The wedges 11 are fixed to a crosshead 15 mounted by a cylindrical stub 16 which axially slides in a bushing 17 fixed in the tubular shaft 10. The bushing 16 mounts a short shaft 18 which extends axially to an inner end provided with a bearing 19 which is axially slidable within the tubular shaft 10. A spiral compression spring 20 encircles the shaft 18 and has one end pressing against the bearing 19 and its other end bearing against the inner end of the bushing 17 which is fixed immovably to the tubular shaft 10. The shaft 18 has an enlarged end 18*a* against which the sliding bearing 19 bears under the bias of the spring 20. It follows that the spring 20 via the shaft 18, bushing 16 and crosshead 15 biases the various sliding elements 11 in a direction permitting contraction of the coiler drum's cylindrical segment 13.

Incidentally, although not shown, the cylindrical segments 13 can be held against falling apart, in the usual way by interfitting tongues and grooves, the details of which do not require illustration.

The tubular drive shaft 5 contains an axially slidable push rod 21 which projects inwardly through the flange 6 and is held centrally positioned by a centering piece 22 which fits within the tubular shaft 10 of the drum and centers that end of the push rod 21 via a bearing or guide bushing 23. The other end of the push rod 21 is correspondingly guided by a bushing 24. At this end the tubular drive shaft 5 extends beyond the coiler's frame part 2 so that it is on the outside of the framework. At this end the drive shaft 5 has a cylinder and piston unit 25 forming a cylinder or fluid pressure area 26 which can be supplied with pressurized fluid via a connection 27 of the rotatively slidable type. In this way fluid pressure can be applied to a piston 28 fixed to that end of the push rod 21.

The introduction of fluid pressure to the space 26 applies force to the piston 28 so as to push the push rod 21 towards the enlarged end 18*a* of the shaft 18, thereby forcing the crosshead 15 to pull the various wedge elements 11 in a direction causing expansion of the drum's cylindrical segments 13.

Figure 2:
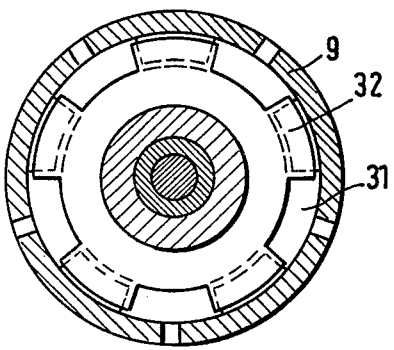
FIG. 2 is a cross section taken on the line I—I in FIG. 1.

The collar 9 has an inward flange 30 which engages the flange 7, these parts forming a bayonet joint as can be seen from FIG. 2. As illustrated, the collar's flange 30 forms circumferentially interspaced lugs which mate with corresponding lugs on the flange 7, rotation of the collar so that its lugs register with the spaces 31 permitting removal of the drum, the interlocking lugs of the two flanges being indicated at 32 in their locked positions. Partial rotation of the drum's flange 7 or of the collar 9 in one direction or the other serves to lock and unlock this bayonet joint, and this can be performed easily in the absence of axial pressure between the parts at 32.

Opposite to the inward flange 30, the collar 9 has an inward flange 33 in screw-threaded connection with the collar and forming on its side towards the flange 6 an annular fluid pressure space or cylinder 34 containing an annular piston 35 which presses against the outer radial surface of the flange 6. An abutment 29 fixed to the tubular shaft 5 via an elastically deformable member 37 keeps the collar's flange 33 from moving too far away from the flange 6.

The annular cylinder 34 is connected with the fluid pressure space 26 of the fluid pressure unit 25 by a radial channel 38 in the flange 33, by a radial channel 39 in the tubular drive shaft 5, and by an annular area 41 between this shaft's inside surrounding the push rod 21, and from there via channels 40 in the push rod 21 and leading to the pressure space 26 via a check valve 42. Once pressure is introduced to the space 26, it goes to the annular cylinder 34 under the control of the check valve 42 which prevents a reverse flow, thus holding the pressure in the annular cylinder 34 of the collar 9. The flange 33 of the collar 9 is provided with a manually operable pressure relief valve 43 to permit release of the pressure in the cylinder 34 when drum removal is desired. The annular space 41 is sealed at its ends by means of sealing elements 44 and 45.

The stop 29 fixed to the shaft 5 extends annularly around the shaft as does the elastically deformable element 37. Actuation of the annular piston 35 by pressure in the annular cylinder 34 causes slight clamping displacement of the ring 9 as required for firm clamping, with consequent compression of the annular member 37 which provides a high elastic resistance as required for adequate clamping together of the flanges 6 and 7. Release of pressure in the space 34 permits expansion of the elastic member 37 to slightly loosen the flange 30 from the flange 7 so the latter or the collar can be rotated. To permit the slight axial movement between the passages 38 and 39, the passage 38 is axially widened as at 38*a* so that fluid communication is always maintained. This widened portion 38*a* can be extended circumferentially to form a complete circle so that if desired the collar 9 can be rotated while communication is continuously maintained between the passages 38 and 39. This permits partial rotation of the collar 9 for locking and unlocking of the bayonet joint parts 32, return of these parts to the position shown in FIG. 2 and the introduction of pressure to the cylinder or space 26 to expand the coiler drum, without registration problems resulting in the introduction of the pressure to the annular cylinder 34.

Assuming that the coiler has been in operation and that it is desired to remove the drum, the pressure still remaining in the annular chamber or cylinder 34 because of the check valve 42, can be released by manual operation of the pressure relief valve 43. The elastically deformable ring 37 then expands slightly, because of its resilience, so that the interlocking bayonet joint elements at 32 are loosened by shifting of the collar 9 slightly in that direction. This permits removal of the drum. Reapplication of the drum involves only the partial rotation of either the drum or the ring 9 for interlocking of the still loose bayonet joint parts at 32. Expansion of the drum for service, by the introduction of fluid pressure to the cylinder 26 so that the piston 28 forces drum expansion as previously explained, simultaneously admits pressure to the annular cylinder 34 of the flange or ring 33 of the collar 9, the annular piston 35 then shifting the collar 9 as required for the application of pressure locking the bayonet joint components at 32 firmly together. The annular elastomer ring 37 working against the annular stop 29 can become compressed until it is no longer appreciably compressible and provides the necessary reaction to the force of the annular piston 35.

Removal of pressure from the space 26 of the unit 25 permits the spring 20 to push the part 19, and, therefore, the shaft 18 in a direction moving the crosshead 15 so it pushes the wedge members 11 to drum contracting positions. The check valve 42 maintains pressure in the annular cylinder 34 so that at this time there can be no unintentional release of the pressure on the bayonet joint components. This pressure can be released only by operation of the pressure relief valve 43.

Although the coiler drum and its connected rotative parts can be rotated while the collar is held against rotation, to effect unlocking of the bayonet joint, it is considered more preferably to turn the collar while the drum and its rotative parts are held against turning.

What is claimed is:

1. A strip coiler comprising an expandable coiling drum having a mounting outward flange on one end, a rotative shaft having an outward flange on one end, said flanges fitting together, a collar encircling said outward flanges and having first and second inward flanges cooperatively embracing the outward flanges, the first inward flange and the corresponding one of said outward flanges forming a releasable form-locking joint, the second inward flange having fluid pressure means working against the adjacent outward flange.

2. The coiler of claim 1 in which said means is formed by an annular cylinder in said second inward flange and containing an annular piston bearing on said adjacent outward flange.

3. The coiler of claim 2 in which said shaft has an axial fluid passage connecting with a radial fluid passage registering with a fluid passage in said second inward flange and leading into its said annular cylinder.

4. The coiler of claim 3 in which the shaft's said passage contains a push rod for actuating said expandable drum, said passage and rod extending to the other end of said shaft and this other end having a fluid actuated means for pushing the push rod, said axial passage being in fluid connection with said fluid actuated means.

5. The coiler of claim 4 in which said fluid connection is via a check valve preventing reverse fluid flow.

6. The coiler of claim 5 in which said fluid passage in said second inward flange registers with said radial fluid passage in said shaft via a passage enlargement maintaining the registration while permitting axial movement of said collar.

7. The coiler of claim 1 in which the joint includes jaws forming a bayonet-type coupling releaseable by relative rotation of the said flanges.

* * * * *